US006227311B1

(12) United States Patent
Osadchuk

(10) Patent No.: US 6,227,311 B1
(45) Date of Patent: May 8, 2001

(54) DRILL PIPE GUIDING APPARATUS FOR A HORIZONTAL BORING MACHINE METHOD

(75) Inventor: Mark Osadchuk, Scottsdale, AZ (US)

(73) Assignee: Ozzie's Pipeline Padder, Inc., Scottsdale, AZ (US)

( * ) Notice: Subject to any disclaimer, the term of this patent is extended or adjusted under 35 U.S.C. 154(b) by 0 days.

(21) Appl. No.: 09/436,010

(22) Filed: Nov. 8, 1999

(51) Int. Cl.[7] ..... E21B 7/04
(52) U.S. Cl. ..... 175/53; 175/61
(58) Field of Search ..... 175/61, 73, 74, 175/75, 53, 89, 108, 113, 121

(56) References Cited

U.S. PATENT DOCUMENTS

| | | | | |
|---|---|---|---|---|
| Re. 33,751 | | 11/1991 | Geczy et al. . | |
| 3,331,454 | | 7/1967 | Conrad . | |
| 3,589,135 | | 6/1971 | Ede . | |
| 3,635,036 | | 1/1972 | Hooper . | |
| 3,693,734 | | 9/1972 | Richmond . | |
| 3,833,077 | | 9/1974 | Lavallee . | |
| 3,837,413 | | 9/1974 | Dunn . | |
| 3,878,903 | * | 4/1975 | Cherrington | 175/45 |
| 3,894,402 | | 7/1975 | Cherrington . | |
| 3,902,563 | | 9/1975 | Dunn . | |
| 3,905,431 | | 9/1975 | Hasewend . | |
| 3,917,011 | | 11/1975 | Hester . | |
| 3,945,443 | | 3/1976 | Barnes . | |
| 4,013,134 | | 3/1977 | Richmond et al. . | |
| 4,043,136 | | 8/1977 | Cherrington . | |
| 4,091,631 | | 5/1978 | Cherrington . | |
| 4,117,895 | | 10/1978 | Ward et al. . | |
| 4,143,721 | * | 3/1979 | Zuvela et al. | 175/45 |
| 4,176,985 | | 12/1979 | Cherrington . | |
| 4,221,503 | | 9/1980 | Cherrington . | |
| 4,248,314 | | 2/1981 | Cunningham et al. . | |
| 4,319,648 | | 3/1982 | Cherrington . | |
| 4,453,603 | | 6/1984 | Voss et al. . | |
| 4,506,745 | * | 3/1985 | Bjor | 175/61 X |
| 4,700,788 | | 10/1987 | Langner . | |
| 5,226,488 | * | 7/1993 | Lessard et al. | 175/61 |
| 5,314,267 | | 5/1994 | Osadchuk . | |
| 5,452,967 | * | 9/1995 | Fuller | 175/61 |
| 5,456,552 | | 10/1995 | Cherrington . | |
| 5,553,680 | | 9/1996 | Hathaway . | |
| 5,628,585 | | 5/1997 | Parish, II et al. . | |
| 5,979,573 | | 11/1999 | Osadchuk . | |
| 5,979,574 | | 11/1999 | Osadchuk . | |
| 6,109,371 | * | 8/2000 | Kinnan | 175/61 |

FOREIGN PATENT DOCUMENTS

| | | |
|---|---|---|
| 832325 | 1/1970 | (CA) . |
| 962996 | 2/1975 | (CA) . |
| 1067-190 | 1/1984 | (SU) . |
| WO 88/08480 | 1/1988 | (WO) . |

OTHER PUBLICATIONS

Trenchless Technology Special Product Focus, *Utility Construction & Maintenance*, Jun./Jul.,1992, p. 29.

* cited by examiner

*Primary Examiner*—Frank Tsay
(74) *Attorney, Agent, or Firm*—Crutsinger & Booth

(57) ABSTRACT

Drill pipe guide apparatus provided for use in conjunction with a pipeline drilling rig as used in drilling substantially horizontal holes for pipe to pass beneath natural or man-made obstruction has a "Vee" shaped trough extending longitudinally from an inclined ramp that serves as a base for the drilling rig. Inverted "Vee", pipe confining members are hingedly mounted at each end of the trough member so as to confine the pipe within the trough but also allow passing a drill string member of larger diameter, such as a stabilizer, by opening and closing each hinge confining member in turn as the stabilizer passes. A hydraulic cylinder member is connected between trough member and the inclined ramp to provide the trough with vertical movement capability for pipe guiding purposes.

9 Claims, 3 Drawing Sheets

DRILL PIPE GUIDING APPARATUS FOR A HORIZONTAL BORING MACHINE METHOD

TECHNICAL FIELD

The present invention relates to horizontal boring for installation of cross-country pipelines, conduits, cables, and the like, beneath a surface obstruction or barrier such as a roadway or river.

BACKGROUND OF THE INVENTION

Pipeline must sometimes be installed under physical barriers such as waterways and buildings or other surface obstructions without disturbing the surface. Typically, this has been done through a process of drilling a pilot bore beneath the surface barrier along a preselected, partially arcuate path. Next, the pilot bore is usually reamed to a larger size as required for the planned services. A pipe line drilling rig is used for this purpose. The rig is mounted on an inclined ramp and includes a rotary drive with hydraulic means for moving the rotary drive up and down the length of the ramp to advance or withdraw the drill string. The ramp is typically provided as the deck of a flat bed trailer, equipped with tracks and a hydraulically powered chain drive mechanism for movement of the rotary drive. The trailer is spotted and dropped nose down on one side of the barrier. The rig is made ready to start drilling stabilizing the trailer deck with hydraulic outriggers and adjusting the ramp angle of inclination as desired for the hole to be drilled. The drill pipe comes in threaded lengths of from twenty-five to thirty-nine feet and generally, an excavating machine is pressed into service to be used as a crane for handling these pipe lengths. The process generally starts with digging a trench, so that the drill bit can bear perpendicularly against the surface where the hole is to enter. The trench also provides a pit for holding the large quantity of drilling mud normally required. As rotary drilling advances the hole, lengths of pipe are added to the drill string until the length planned for the initial tangent is reached. The pipe string is then pulled out of the hole so that a mud-powered drill motor can be installed in place of the rotary drill bit. The mud-powered drill motor is mounted with its drilling axis angularly offset from the drill string axis by approximately 2°, so as to cause the drill to advance along a predictable arcuate path. The drill motor is positioned with its angularly offset axis oriented upward. Thus positioned, running the drill motor and advancing the drill string by axial hydraulic force only, without drill string rotation, generates an upwardly curving hole. Since the radius of hole curvature is predictable, calculations can determine the additional length of drill pipe needed to bring the hole to the surface or to make a transition to a predetermined tangent for reaching the surface. The bore has a larger diameter than the drill pipe for drilling fluid or "mud" circulation. This allows cuttings to be removed from the hole by mud circulation through the drill pipe, across the cutting face, through the open annulus and back to the surface.

Starting a straight "horizontal" hole can be difficult, especially if the entry point is more than a few feet from the end of the trailer, because the drill pipe tends to droop under its own weight. Physical considerations, such as the size and location of the trench and mud pit, often dictate an entry point twenty-five feet or more from the end of the trailer. In these cases, starting a straight hole is particularly difficult and it is important to get the hole started straight in order to follow a predictable path.

Unlike in vertical drilling, where drill string weight crowds the drilling tool against the cutting surface, the crowding force in this type of more or less horizontal drilling must be applied by pushing on the drill string. As the hole gets longer, the drill string reaches a length where it is unstable under the necessary column load, so that it deflects and bears randomly against the side of the hole. This deflected, off-center pipe can also cause whipping between the rotary drive and the hole entry point. Fluted members called stabilizers, sized to pass through the bore diameter with minimal clearance, are fitted to the drill string at intervals. The stabilizers center the drill string in the bore and help in holding direction as the hole progresses. The stabilizers also help to control pipe whipping.

Another problem peculiar to horizontal drilling is the difficulty in supporting the pipe to hold the male and female threaded ends in axial and angular alignment as lengths are added to or removed from the pipe string. This problem is worsened by increasing droop as the unsupported pipe length between the end of the ramp and the entry point increases.

Therefore, a first object of the present inventions is to provide apparatus for guiding the drill pipe so as to facilitate drilling a straight hole at entry. A second object is that this apparatus prevent drill pipe "whipping" by keeping it centered while drilling. A third object is that this apparatus facilitate re-entry of the hole when the drill pipe has been pulled out. A fourth object is that this apparatus be capable of supporting the drill pipe between the hole and the end of the inclined ramp so that the threaded end is held in alignment with the rotary drive while pipe is added to or removed from the drill string and yet another object is that this apparatus be made in a form that does not interfere with the normal coupling of a trailer mounted horizontal drilling rig.

SUMMARY OF THE INVENTIONS

The present inventions contemplate improved apparatus for achieving the aforesaid objectives by providing apparatus for supporting and centralizing drilling pipe in a more or less horizontal drilling rig. Practice of the present inventions uses some steps and apparatus well known in the pipeline drilling arts and therefore, not the subject of detailed discussion herein.

A "Vee" shaped trough is extended past the end of the inclined ramp and located in line with the rotary drive to support the drill pipe string as it is driven to rotate. A similar inverted "Vee" shaped member is mounted at each end of the trough with a hinged connection so that it can be placed in a closed, pipe confining position or in an open, unconfining position. Both the trough and the inverted, pipe confining member are lined with slabs of low friction, abrasion resistant material for contact with the rotation pipe. The substantially square clearance path through the trough and pipe confining members is large enough to allow passage of the pin and box drill pipe connections but suffices to provide guidance and centralizing to the drill string. The trough is mounted in such a manner as to be removable when necessary for transportation and furthermore, the mounting provides for controlled vertical movement of the trough relative to the inclined ramp. This vertical movement enables adjustment to compensate for vertical deflection of the drill string when it is extended beyond the end of the ramp.

BRIEF DESCRIPTION OF THE DRAWINGS

The accompanying drawings are incorporated into and form a part of the specification to assist in explaining the present inventions. The drawings illustrate preferred and alternative examples of how the inventions can be made and used and are not to be construed as limiting the inventions to only those examples illustrated and described. The various advantages and features of the present inventions will be apparent from a consideration of the drawings in which.

DETAILED DESCRIPTION OF THE DRAWINGS

Figure 1:
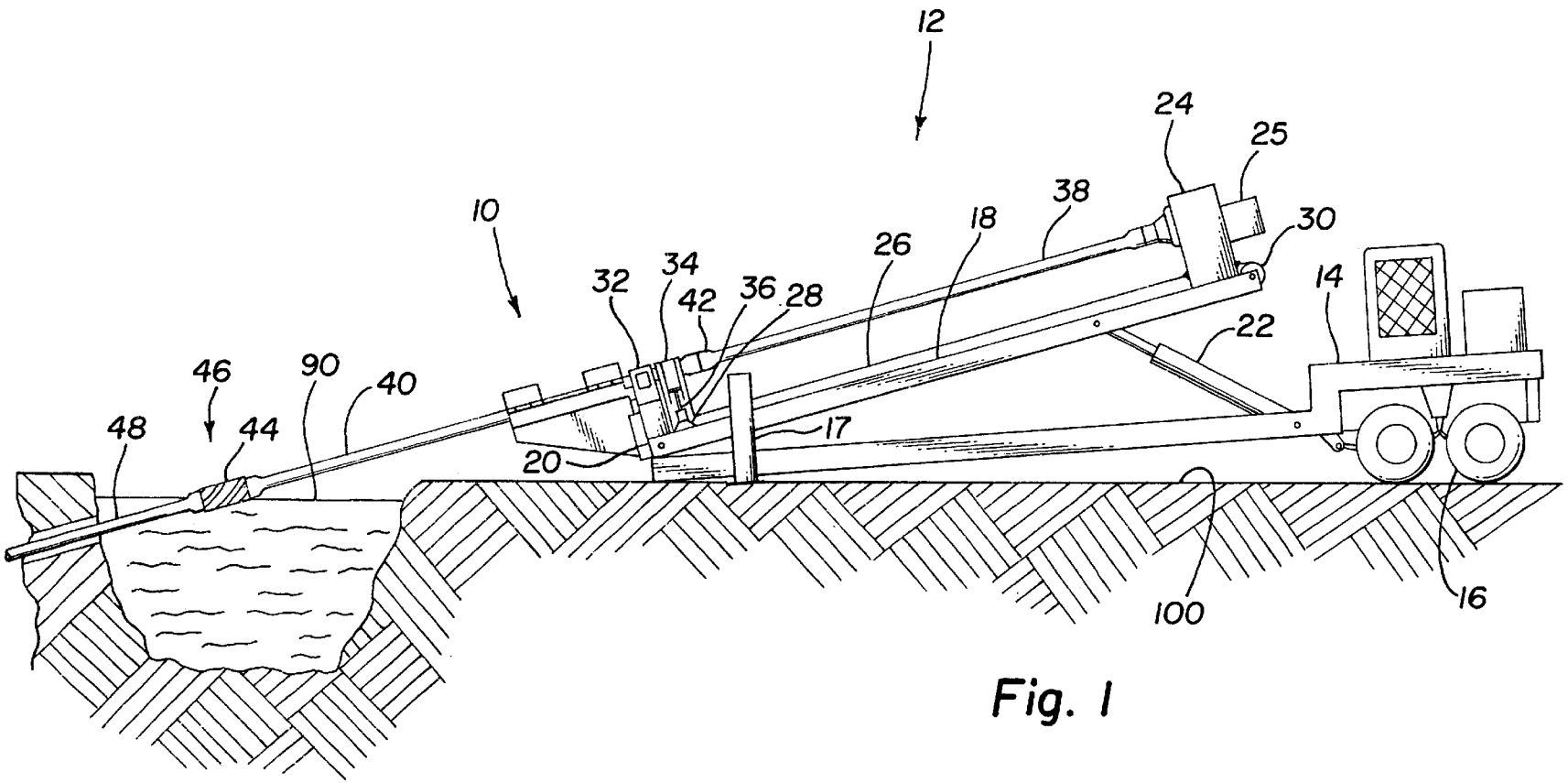
FIG. 1 shows a side view of a preferred embodiment of the present inventions as installed on a typical pipeline hole drilling machine.

The embodiments shown above and described herein are exemplary. Many details are well known in the art, and as such are neither shown nor described. It is not claimed that all of the details, parts, elements, or steps described and shown were invented herein. Even though numerous characteristics and advantages of the present inventions have been described in the drawings and accompanying text, the description is illustrative only, and changes may be made in the detail, especially in matters of shape, size, and arrangement of the parts within the principles of the inventions to the full extent indicated by the broad general meaning of the terms used in the attached claims. The present inventions are described in the following by referring to drawings of examples of how the inventions can be made and used. In these drawings, reference characters are used throughout the several views to indicate like or corresponding parts.

FIG. 1 shows a side view of a preferred embodiment of the present inventions 10 as installed on a typical pipeline hole drilling machine 12. In this case, drilling machine 12 comprises a two axle trailer 14 with undercarriage 16 and ground contacting stabilizers 17. Inclined ramp 18 is pivotally mounted at nose end 20 and is raised and lowered by a pair of hydraulic cylinders 22. Rotary drive gear reducer 24 is mounted for movement along the length of inclined ramp 18. Such movement is powered by pull-down cables 26 running over idler sprockets 28 and powered sprockets 30. Also to be noted at nose end 20 are stationary jaw assembly 32 and rocking jaw assembly 34 with hydraulic cylinders 36, whereby the threaded connections in drill string 50 can be tightened and loosened or "made-up and broken". In actual practice, the rotary drive is threaded onto third drill pipe 38 and stationary jaw assembly 32 clamps second drill pipe 40 below typical threaded connection 42 so that most of the thread engagement or disengagement of connection 42 is done by rotation of rotary drive assembly 24 under power. Only a small fraction of a turn needs to be made or broken by the force of hydraulic cylinders 36 of rocking jaw assembly 34. It is notable that a typical stabilizer 44 is included in threaded connection 46 of second drill pipe 40 to first drill pipe 48 in drill string 50.

Figure 2:
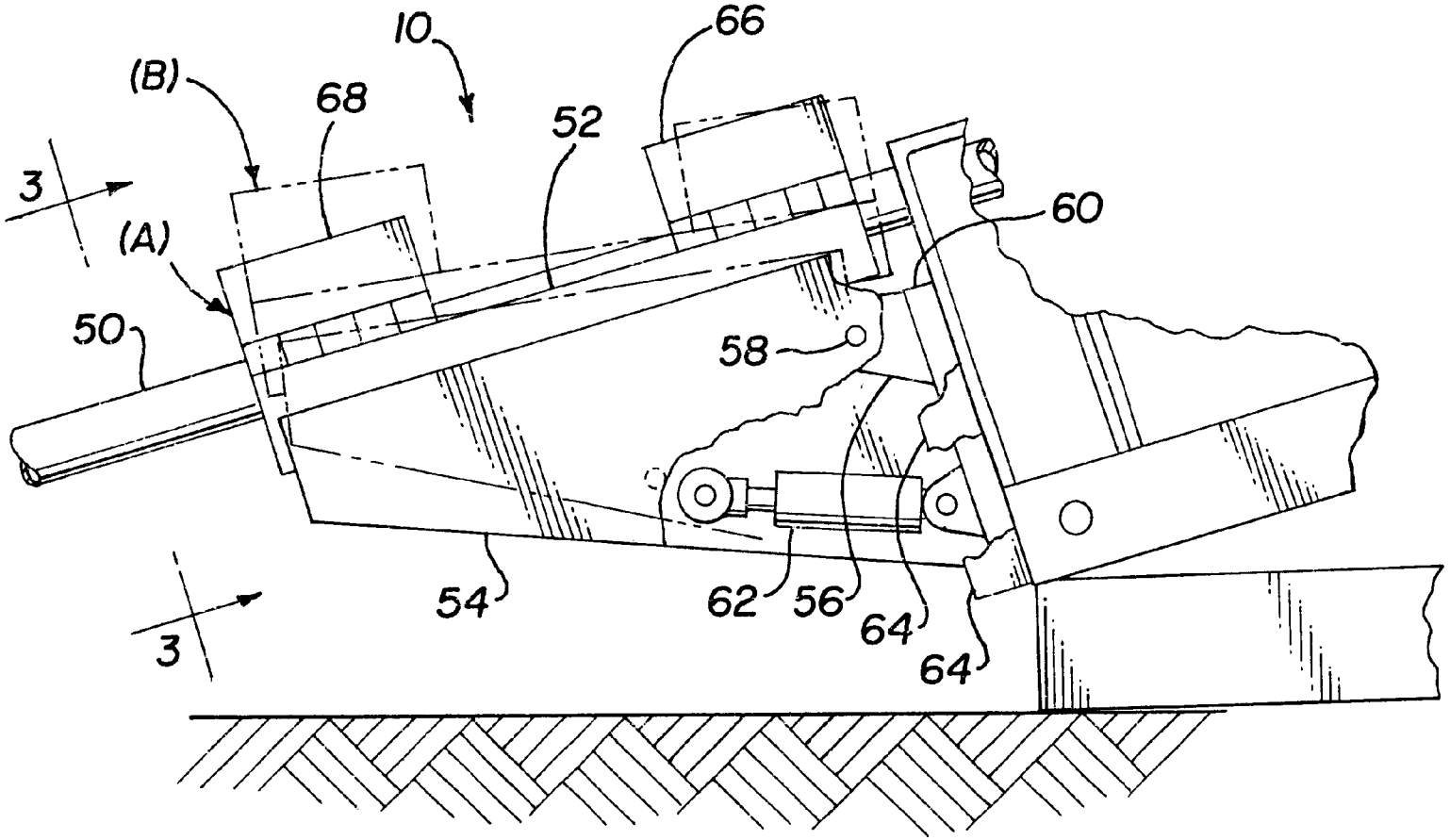
FIG. 2 shows a more detailed side view of a preferred embodiment of the present inventions.

FIG. 2 shows an enlarged view of preferred embodiment 10 where it is seen that "Vee" trough member 52 is supported by gusset members 54 and that gusset members 54 are pivotally mounted on bracket 56 by pivot pin 58. Bracket 56 is joined to base plate 60, to which hydraulic cylinder 62 is attached. Thus, trough member 52 can be moved vertically above and below the nominal, or "in line" position (A) shown. An elevated position (B) is shown in phantom lines. Base plate 60 is removably connected to nose end 20 of inclined ramp 18 by sliding ways 64 so that the entire assembly 10 may be removed for transportation to another location. Connected across the open "Vee" of trough member 52 by a plurality of hinge connections 70, with hinge pins 72, are first and second pipe confining members 66 and 68 respectively. It is to be noted that pipe confining members 66 and 68 are spaced apart by a dimension exceeding the length of stabilizer 44 for reasons described herebelow.

The vertical movement of guide embodiment 10 provides a force couple which deflects the outwardly extending drill string 50 either upwards or downwards as the driller requires. Moving guide 10 for upward deflection of drill string 50 is useful in overcoming gravity induced downward deflection of the drill bit (droop) when starting or re-entering the hole. Moving guide 10 for downward deflection of drill string 50 is useful in straightening a starting hole when it is tending downward. The downward deflection brings the drill pipe to bear against the lower side of the entry hole and causes the drill bit to tend upward for a straighter hole.

The difficulty in supporting the pipe to hold the male and female threaded ends in angular alignment as lengths are added to or removed from the pipe string is also addressed by the present invention. Vertical movement of drill string guide 10 provides compensation for the increasing droop as the unsupported pipe length between the end of the ramp and the entry point increases so that the operator can align the threaded ends.

Figure 3:
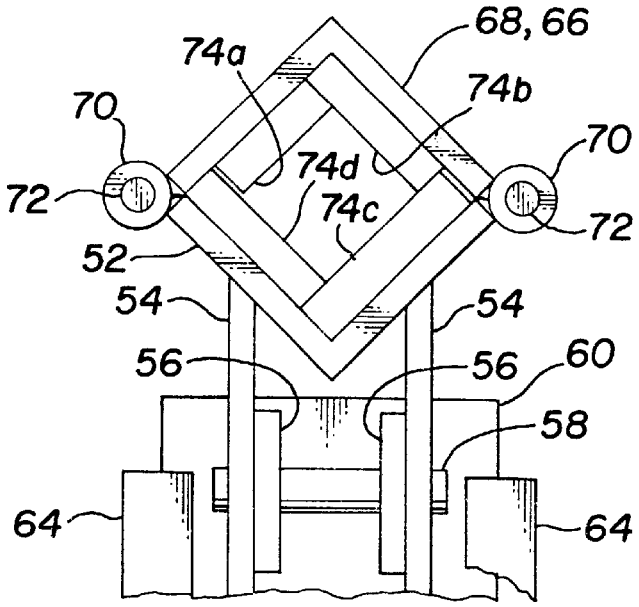
FIG. 3 shows an end view of the embodiment of FIG. 2 in the closed position.
Figure 4:
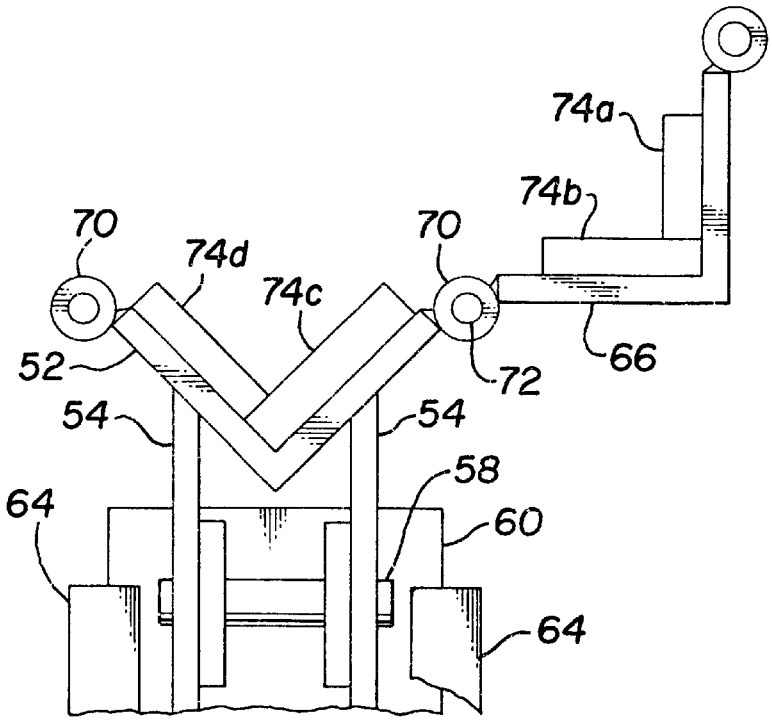
FIG. 4 shows an end view of the embodiment of FIG. 2 in the open position.

FIGS. 3 and 4 show a partial end views of embodiment 10 as seen from the direction of arrows 3—3 in FIG. 2. Here is shown the manner whereby hinge connections hold confining members 66 and 68 in assembly with "Vee" trough member 52 so as to form an essentially square confining guideway. The guideway is lined with wear pads 74*a–d* of low friction, abrasion resistant UHMW polyethylene to provide a loose fit for drill string 50 and allow passage of typical connections 42. Connections such as connection 46, wherein larger diameter stabilizer 44 is included, are allowed to pass by pulling pins 72 from hinge 70 on one side of first confining member 66 and swinging it to the open position shown in FIG. 4. After drilling has progressed to advance stabilizer into the space between confining members 66 and 68, first confining member 66 is closed and locked in place by re-insertion of pin 72. Then second confining member 68 is opened and drilling resumed until it too can be re-closed and locked in the same manner. The same operating sequence allows passage of a larger diameter reamer.

The restrictive description and drawings of the specific examples above do not point out what an infringement of this patent would be, but are to provide at least one explanation of how to use and make the inventions. The limits of the inventions and the bounds of the patent protection are measured by and defined in the following claims.

Although the inventions have been described with reference to these preferred embodiments, other embodiments can achieve the same results. Variations of the present invention will be apparent to those skilled in the art without departing from the scope and spirit of the inventions.

Having described the inventions, what is claimed is:

1. Drill pipe guide apparatus for a pipeline drilling rig with a longitudinal inclined ramp, as is used for drilling a substantially horizontal hole, the drill pipe guide apparatus comprising:

a trough member located along the central axis of the drill pipe for support thereof, the trough member being mounted for substantially vertical movement with respect to the inclined ramp and having longitudinally oriented first and second ends;

a drill pipe confining member mounted at the first end and movable between a closed pipe confining and guiding first position to an open and unconfining second position;

a drill pipe confining member mounted at the second end and moveable between a closed pipe confining and guiding first position to a open and unconfining second position; and means for moving the confining members between the first and second positions.

2. Drill pipe guide apparatus for a pipeline drilling rig with a longitudinal inclined ramp according to claim 1, wherein the drill pipe guide apparatus extends beyond the length of the inclined ramp.

3. Drill pipe guide apparatus for a pipeline drilling rig with a longitudinal inclined ramp according to claim 1 and further comprising:

a frame member extending from the longitudinally inclined ramp to support the drill pipe guide apparatus; and a hydraulic cylinder connected between the inclined ramp and the frame member to move the frame member vertically with respect to the inclined ramp.

4. Drill pipe guide apparatus for a pipeline drilling rig with a longitudinal inclined ramp according to claim 1, wherein the trough member further comprises longitudinal, upwardly extending sides in a "Vee" arrangement.

5. Drill pipe guide apparatus for a pipeline drilling rig with a longitudinal inclined ramp according to claim 1, wherein the drill pipe confining member further comprises:

an inverted "Vee" member hingedly attached to the trough member for movement between the first and second positions; and means for latching the confining member in the first position.

6. Drill pipe guide apparatus for a pipeline drilling rig with a longitudinal inclined ramp according to claim 1 wherein the trough member is internally lined with low friction material.

7. Drill pipe guide apparatus for a pipeline drilling rig with a longitudinal inclined ramp according to claim 1 wherein the pipe confining member is internally lined with low friction material.

8. Drill pipe guide apparatus for a pipeline drilling rig with a longitudinal inclined ramp according to claim 1 wherein the trough member and the drill pipe confining member are internally lined with low friction material.

9. Drill pipe guide apparatus for a pipeline drilling rig with a longitudinal inclined ramp according to claim 1 and further comprising two pipe confining members, one located at wherein the trough member is internally lined with low friction material.

* * * * *